US009644391B1

(12) United States Patent
Urhausen et al.

(10) Patent No.: US 9,644,391 B1
(45) Date of Patent: May 9, 2017

(54) ANCHOR SYSTEM

(71) Applicants: JJ Urhausen, Eugene, OR (US); Paul Silva, Springfield, OR (US)

(72) Inventors: JJ Urhausen, Eugene, OR (US); Paul Silva, Springfield, OR (US)

(73) Assignee: DLX Global, LLC, Eugene, OR (US)

( * ) Notice: Subject to any disclaimer, the term of this patent is extended or adjusted under 35 U.S.C. 154(b) by 0 days.

(21) Appl. No.: 14/463,153

(22) Filed: Aug. 19, 2014

Related U.S. Application Data

(60) Provisional application No. 61/867,341, filed on Aug. 19, 2013.

(51) Int. Cl.
*E04H 15/62* (2006.01)
*B65D 30/00* (2006.01)

(52) U.S. Cl.
CPC ..... *E04H 15/62* (2013.01); *B65D 29/00* (2013.01)

(58) Field of Classification Search
CPC ..... E04H 15/62; E04H 15/64; E04H 15/32; B65D 65/22; B65D 37/00; B65D 85/00; B65D 90/12; B65D 29/00; B65D 33/14; B56D 33/28
USPC ..... 135/96, 118, 119, 120.1, 120.4; 52/2.24–2.25, 3–5, 23; 248/364, 346.2, 248/346.3, 500, 910; 150/106, 108, 154, 150/158, 166; 383/26, 79, 86.1, 93, 38, 383/13; 220/495.01, 476, 480–482; 224/484, 567.568, 403, 42.4
See application file for complete search history.

(56) References Cited

U.S. PATENT DOCUMENTS 3,225,806 A * 12/1965 Pollak ..... A45C 3/00 206/315.9
4,887,627 A * 12/1989 Audet ..... E04H 15/64 135/120.1
5,160,196 A * 11/1992 Curtis ..... B65D 33/007 383/33
5,179,968 A * 1/1993 Deichmann ..... B64F 1/005 135/88.01
5,503,476 A * 4/1996 Hamdan ..... D06F 95/002 224/585
6,105,305 A * 8/2000 Edens ..... A01K 97/20 224/406
6,739,095 B2 * 5/2004 Glynos ..... A01F 25/13 248/910
7,231,953 B2 * 6/2007 Varley ..... E06B 9/13 160/133
7,871,052 B2 * 1/2011 Baum ..... B60P 3/343 135/115
8,157,140 B2 * 4/2012 Jay ..... A45C 1/06 224/269
8,327,863 B1 * 12/2012 Dupree ..... A45F 5/00 135/16
9,045,274 B2 * 6/2015 Matye ..... B65B 39/06
2002/0026890 A1 * 3/2002 Zook ..... B63B 21/29 114/294

(Continued)

*Primary Examiner* — Winnie Yip
(74) *Attorney, Agent, or Firm* — MacCord Mason PLLC

(57) ABSTRACT

An anchor and shelter system is shown and described. In one embodiment, the anchor includes a pair of collapsible walls and opposing sidewalls to define a bladder opening. The anchor may include a plurality of parallel engagement apertures and side apertures to secure the anchor to a shelter. The result is an anchor that provides efficient and secure support for an adjacent shelter.

8 Claims, 5 Drawing Sheets

(56) References Cited

U.S. PATENT DOCUMENTS

| | | | | |
|---|---|---|---|---|
| 2006/0150537 | A1* | 7/2006 | Baum | A01F 25/13<br>52/90.1 |
| 2008/0035254 | A1* | 2/2008 | Brayshaw | B60J 11/06<br>150/154 |

* cited by examiner

ANCHOR SYSTEM

This application claims the benefit of U.S. provisional application No. 61/867,341, filed Aug. 19, 2013, which is incorporated herein by reference in its entirety.

FIELD OF THE TECHNOLOGY

The present disclosure relates generally to anchor systems, and more particularly to improved shelters and shelter anchor assemblies.

BACKGROUND

Shelters, tents, rapid-deployment shelters, forts and the like typically include sheets of fabric, or other materials, secured to a frame. Often these units are free-standing or are similarly semi-attached to a ground surface or tangential fixture. Typically, guy ropes help anchor the unit to a ground surface. However, positioning the guy ropes on a surface is often a difficult and demanding task, particularly during emergency situations and in uncertain environmental conditions. Further, maintaining a secured and taught connection between the unit and the guy rope to hold the assembly in place is also difficult in demanding environments.

For instance, rapid tactical shelters are used in a variety of demanding on-site scenarios including fire, incident command, communication areas, crime scene investigation, flu vaccination, military deployment and other on-site emergency response spots in a variety of challenging terrains, and environmental conditions. Rapid deployment, with quick and easy set-up and take-down, and securing of such units is often beneficial, if not necessary. Conventional roping, tent pegging, and weight anchor systems have been used to position such units, but these conventional systems fail to provide the simple, rapid, efficient and secure anchor that is needed in these situations. Deployment situations may be, for example, on concrete where pegs are not penetrable, on uneven surfaces or in barren places devoid of structures on which to secure roping and/or at remote locations making transportation of weights impractical.

Therefore, Applicants desire systems and methods for anchor systems and deployment shelters without the drawbacks presented by the traditional systems and methods.

SUMMARY

In accordance with the present disclosure, anchor systems and shelter assembles are provided for securing shelters, forts deployment tents and the like. This disclosure provides an improved anchor system that is convenient, efficient, easily portable and safe for the user, particularly when used for maintaining deployment shelters in a fixed position in a variety of environmental conditions.

In one embodiment of the present disclosure, a system for use with a shelter includes a collapsible anchor, a plurality of parallel engagement apertures, a closure band and a side aperture. Typically, the collapsible anchor has a pair of opposing walls and a pair of opposing sidewalls. The opposing walls and the opposing sidewalls may define a top opening with an anchor cavity. The plurality of parallel engagement apertures may be spaced along an upper portion of the opposing walls. The closure band may be strung between two of the engagement apertures, for instance the closure band may cinch the top opening. The side aperture on a distal end of an upper portion of the sidewall may be adapted to a secure a leader to the anchor.

In some examples, the collapsible anchor includes an inner liner. The collapsible anchor may be a semi-rigid frame. For instance, the semi-rigid frame may be adapted to retain a substance chosen from water and sand. The plurality of engagement apertures may be spaced evenly along the top opening Each of the anchor sidewalls may include a wide lower portion and a narrow upper portion. Typically, the shelter is portable.

In another embodiment of the disclosure, an anchor for securing a shelter to a surface includes a base, a first and second collapsible wall, a third and fourth collapsible sidewall, and at least one inner sidewall. Typically, the base contours flatly on a surface. The first and second collapsible wall may extend upwardly away from the base. Each the sidewall may include a wider lower portion and a narrow upper portion. The at least one inner sidewall may be secured between the first and second collapsible walls, and in some cases partially separate the anchor into at least two compartments. The first and second walls may oppose one another and the third and fourth sidewalls may oppose one another. Further, the first and second walls may be substantially perpendicular to the third and fourth sidewalls.

In some examples, a surface area of an upper face of the anchor is smaller than a surface area of a footprint of the base. The first and second walls and the third and fourth sidewalls may define a semi-rigid frame. The frame may include an enforcement strip. The collapsible walls may include a plurality of parallel engagement apertures. A closure band may be strung between parallel engagement apertures. At least one of the collapsible sidewalls may include a side aperture secures a leader. The inner sidewall may include a flange securing the inner sidewall to the wall. Typically, the anchor is portable.

A further embodiment of the present disclosure is an anchor system for securing a shelter to a surface having a collapsible anchor and a securing system. In one example, the a collapsible anchor may include a base having an inner liner; a first and second collapsible wall extending upwardly away from the base; a third and fourth sidewall, wherein each the sidewall includes a wide lower portion secured to the base and a narrow upper portion secured to the walls; and at least one inner sidewall partially separating the anchor into at least two compartments. The system may include a plurality of parallel engagement apertures that are spaced along an upper portion of the first and second collapsible walls. The system may include a closure band strung between parallel engagement apertures. In some examples, a proximal aperture and a distal aperture may be positioned on the collapsible anchor to secure leaders to the shelter.

In another example, the anchor system may be a multi-point anchor system for securing a shelter to a surface. The collapsible anchor may include a base and a first and a second collapsible wall, the first and second walls extending upwardly away from the base; a third and fourth sidewall, wherein each the sidewall includes a wide lower portion secured to the base and a narrow upper portion secured to the walls; and at least one inner sidewall partially separating the anchor into at least two compartments. In this example, the anchor system engages more than one point on the shelter. In some examples, the anchor system interfaces with at least two corner points of the shelter. The anchor system may secure one side of a shelter. One or more anchor systems may be used to secure a shelter to a surface.

In yet further examples, the base contours flatly to the surface in an assembled position. The system may include at least one leader. The collapsible anchor may be a semi-rigid frame that is a multi-use design, and may generally retain a substance chosen from water and sand.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
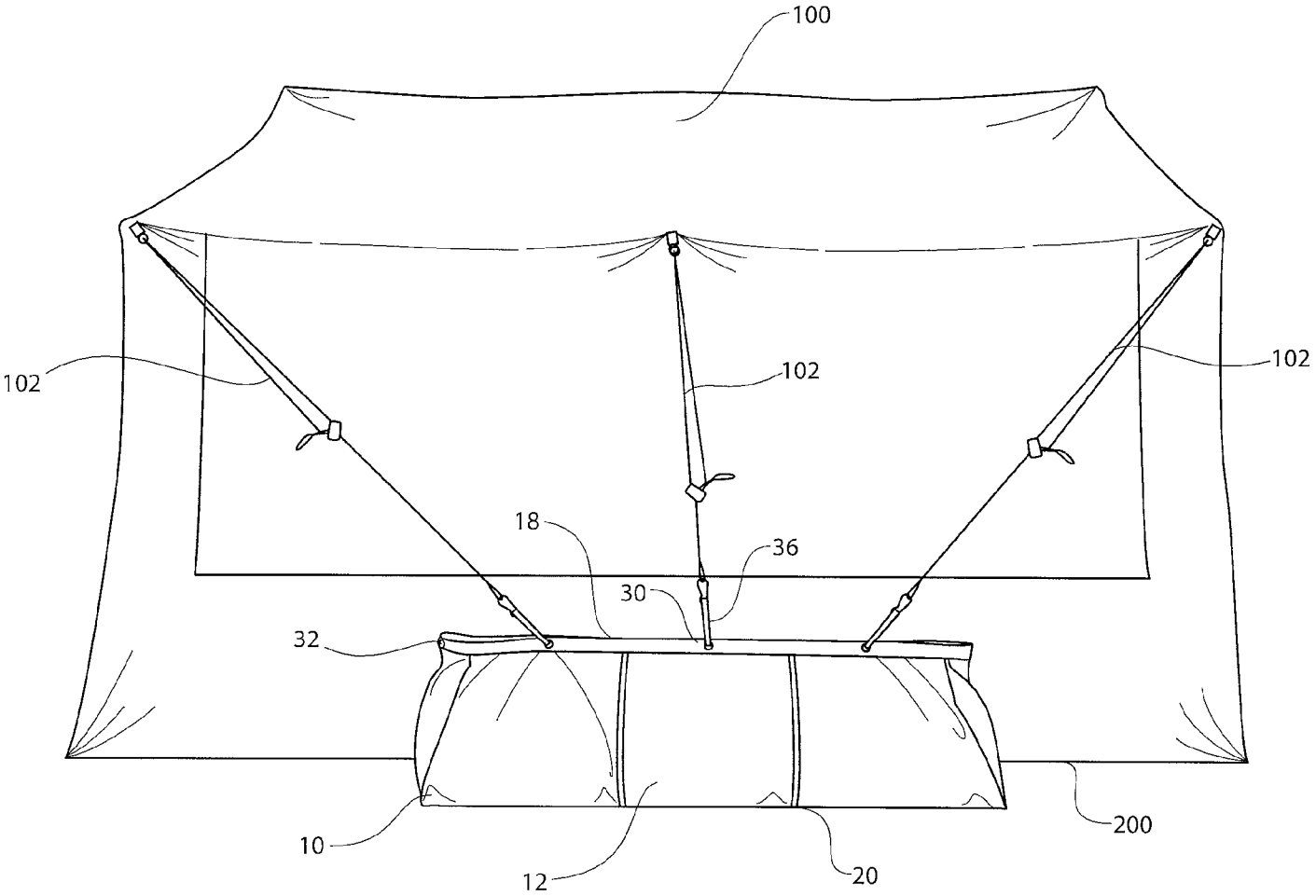
FIG. 1 is a side perspective view of an anchor system and a deployment shelter according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
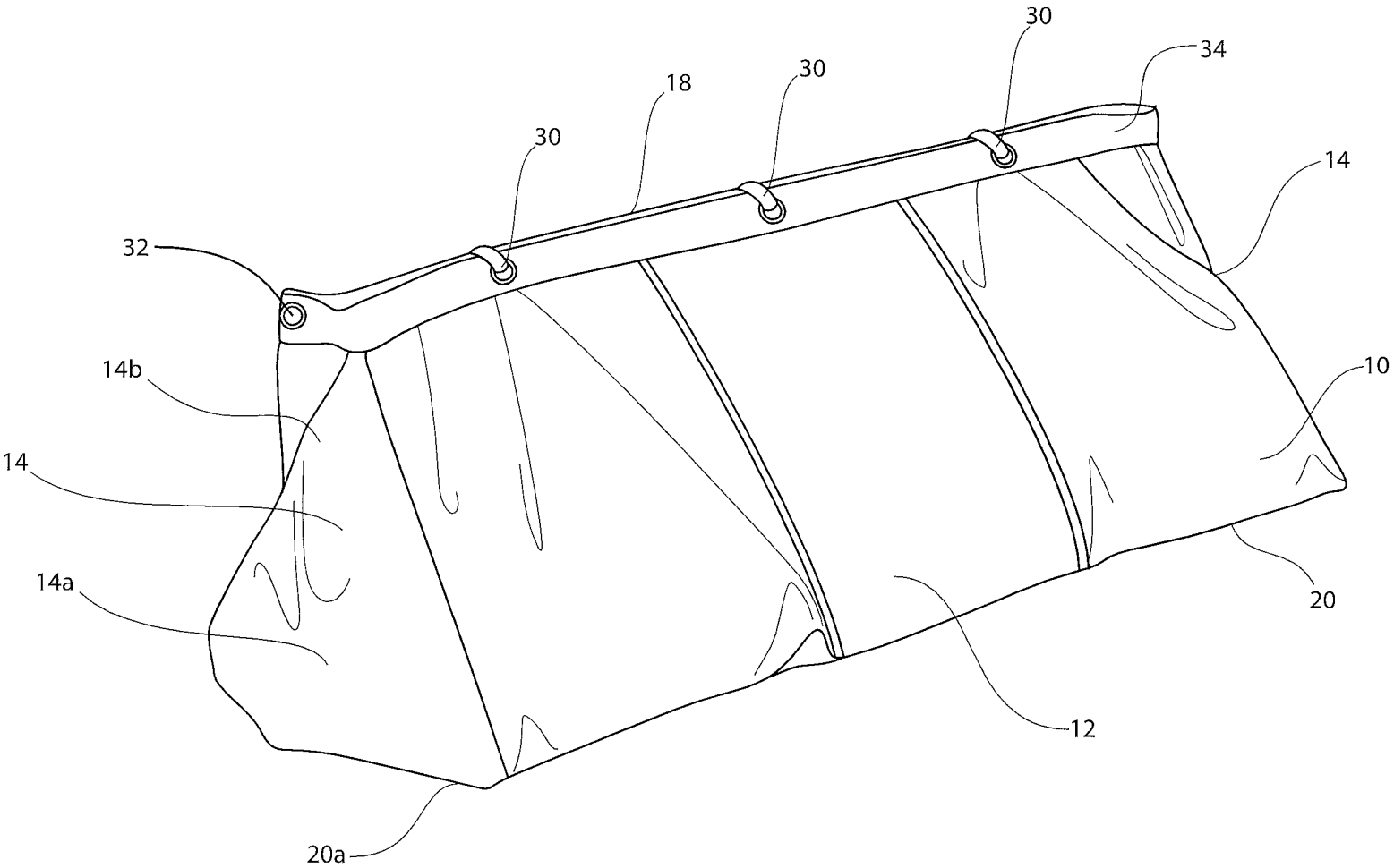
FIG. 2 is a side perspective view of anchor system elements introduced in the embodiment of FIG. 1, with elements removed for clarity.

Referring now to the drawings in general and FIGS. 1 and 2 in particular, it will be understood that the illustrations are for the purpose of describing embodiments of the disclosure and are not intended to limit the disclosure or any invention thereto. As best seen in FIG. 1, a shelter 100 and anchor 10 are shown embodied according to the present disclosure. Anchor 10 may include a pair of opposing collapsible walls 12 and a pair of opposing sidewalls 14 with a top opening 18. The anchor 10 may include a plurality of engagement apertures 30 to cinch closed the top opening 18 and side apertures 32 to secure guy leaders 102 between the shelter 100.

Figure 5:
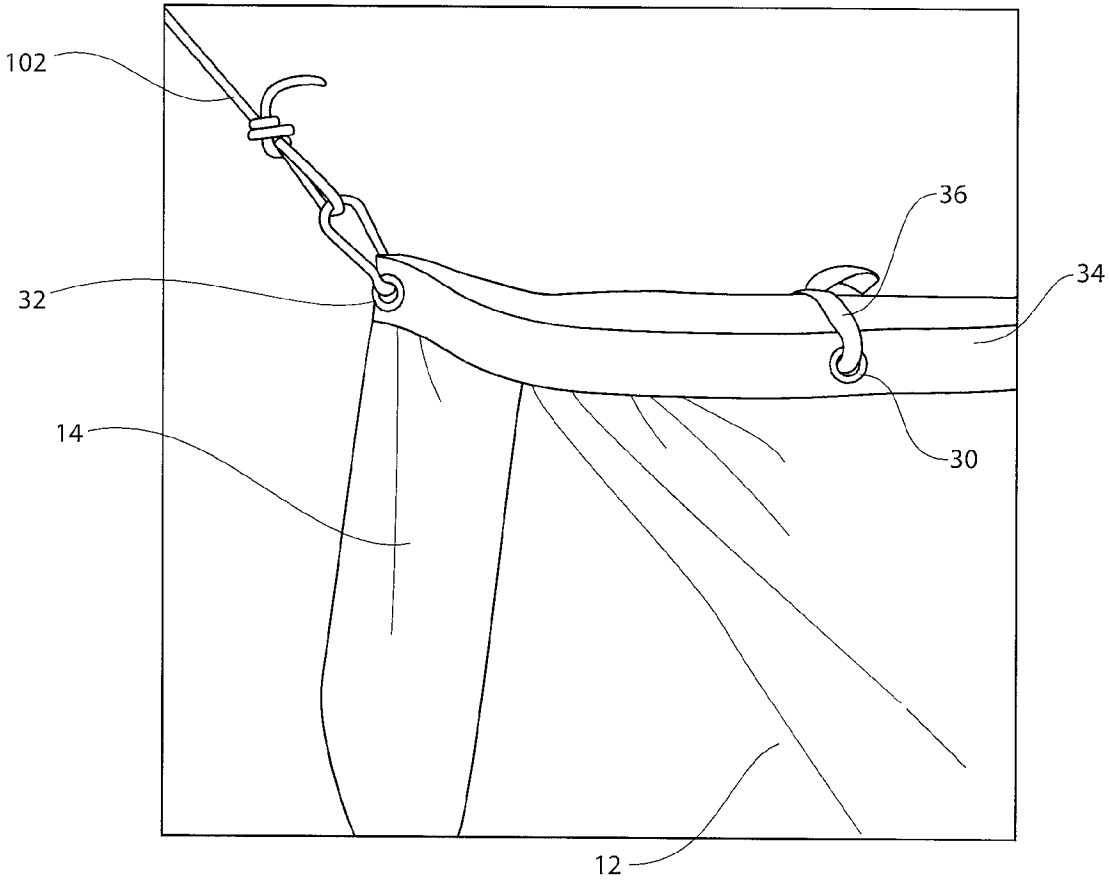
FIG. 5 is an isolated side perspective view of elements of an anchor system.

As shown in FIG. 1, anchor 10 is generally configured to receive and retain materials, such as water, sand, rock, dirt, bricks and the like, and is typically aligned adjacent to any of the shelters shown and described herein. Anchor 10 includes a base 20, which may include any variety of base linings, inner frames and the like to generally mate with any contour of surface 200. Base 20 may be reinforced for durability to endure dragging and contact with rough surfaces. Further, the sidewall 14 may include a sidewall base 20*a* that traverses distally away from the base 20 to provide a greater footprint of support on the surface 200. The anchor includes at least a pair of opposing walls 12. As shown in FIGS. 1, 2 and 5, the first and second walls 12 may be constructed of collapsible materials for ease of storage, set-up and carry. Portability of the anchor allows any of the anchor embodiments and examples shown and described herein to be transported to remote and difficult to reach locations, for instance because the anchors are lightweight to carry and collapsible.

The sidewalls 14 are secured adjacent to the walls 12 in any manner, including one piece construction or support edges as shown in the various views. Unexpectedly, Applicants have discovered the onion-like shape defined by the sidewalls and walls creates a unique bladder for filling with unique stability features. As shown in FIG. 2, the sidewall 14 includes a wide lower portion 14*a* and a narrow upper portion 14*b*. The lower footprint surface area is thus larger than the upper surface area to provide structural integrity against environmental conditions, for example, severe weather and uneven ground, for instance by lowering the center of gravity of the anchor and expanding the base support to contour with the surface 200. In some examples, the anchor 10 may be constructed from heavy UV, mildew and fire-resistant vinyl and nylon. In other examples, bags filled with materials, such as rocks, dirt and water may be fitted and inserted into the anchor. The anchor 10 is configured for quicker and easier fill, while still being durable, lightweight and easily transportable. The anchor 10 is environmentally friendly as it allows minimal environmental impact in environmentally sensitive areas. Weighted unnatural substances need not be imported for fill and minimal disturbance to the environment is achieved. The anchor 10 is a no-impact anchor that stabilizes and secures shelters without the need for drilling and/or attaching to existing structures.

The perimeter of the upper anchor, i.e. the upper walls 12 and sidewalls 14, generally define the top opening 18 to expose the anchor's bladder. As discussed hereinafter, the anchor may include one bladder or a plurality of segmented, or partially separated, bladders. The bladder may be single lined or include multiple liners for secure handling of a variety of filling materials, which include, but are not limited to, water, rock, dirt and sand. The anchor's ability to hold a variety of filling materials allows the anchor to be carried collapsed and unfilled during a deployment and then to be filled with whatever materials are available on site. The filling materials may be emptied then on-site when leaving the deployment and the anchor collapsed for easy return carry. This allows deployed personnel to minimize the supplies needed and prevents having to carry, often excessively heavy, items for securing the tent or shelter. The upper perimeter may include an enforcement strip 34 and a variety of securement apertures. In some examples, the enforcement strip is reinforced fabric, plastic and the like to provide structural integrity around any of the securement apertures. Side strips 50 may be provided down the sidewalls 14 of the anchor.

Often, in rapid deployment situations, access to materials is limited and shelters may be quickly set-up in a variety of environments. Conventional types of anchors for shelters do not function as multi-use, for example, accommodating a variety of weighted substances such as sand and/or water and/or materials available at the deployment site. Further, conventional types of anchors for shelters do not function in a multitude of unexpected environments, such as, by way of example, shelters set-up on concrete or asphalt in one instance, unlevel ground, remote locations with limited access to either water and/or sand in other deployment instances. Applicant's anchor system accommodates a variety of weighted substances in a variety of deployment conditions.

Figure 3:
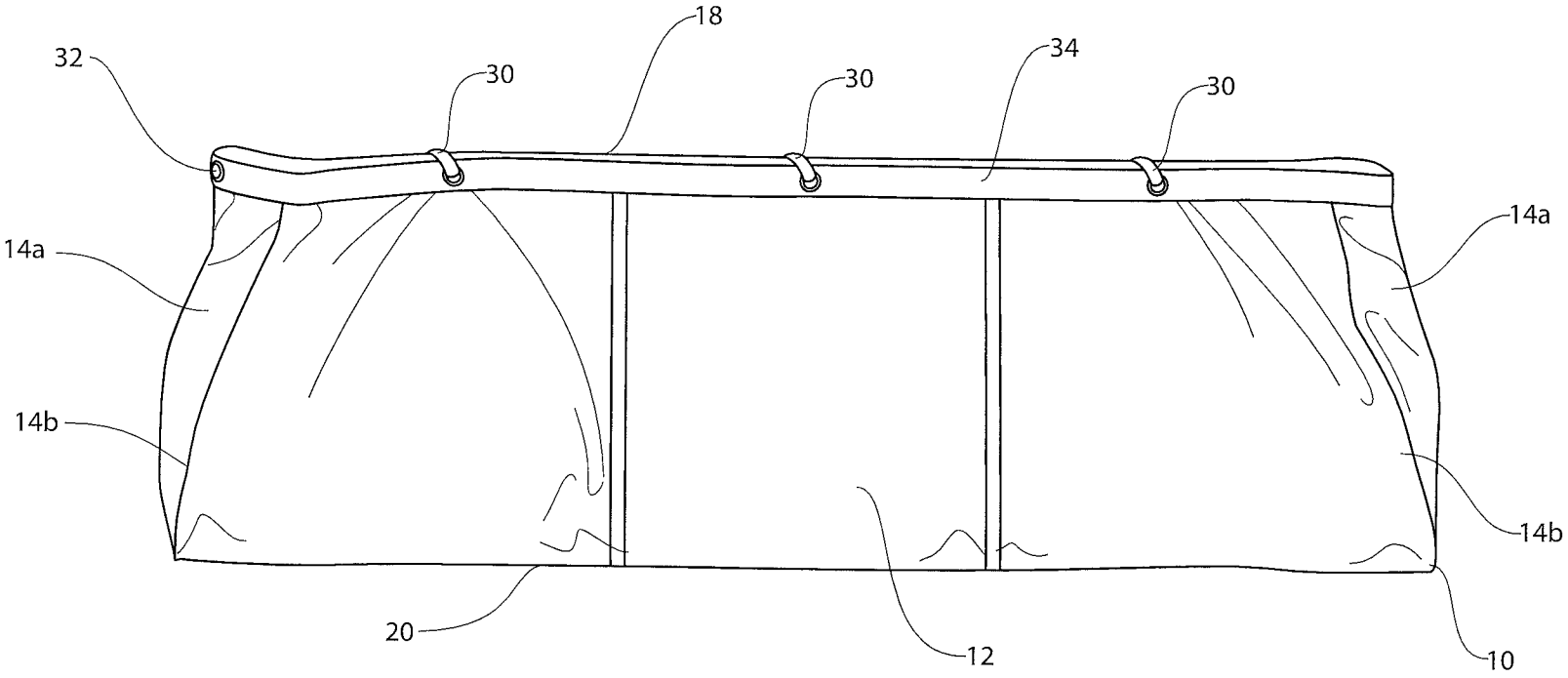
FIG. 3 is a side perspective view of an anchor system according to the embodiment of FIG. 1.

The anchor includes engagement apertures 30 to generally secure the top opening in a closed position by cinching the opposing walls 12 together. As shown in FIGS. 2 and 3, parallel engagement apertures 30 may be spaced parallel and opposed from one another on the walls 12. Further, the anchor may include side apertures 32 to generally secure guy leaders, and the like, between the anchor 10 and shelter 100. In addition, guy leaders may be secured to fasteners of the engagement apertures as shown herein. Those of ordinary skill in the art having the benefit of this disclosure will recognize that any of the apertures described herein include a variety of sizes, shapes, styles and support backings to generally secure guy leaders, ropes, bands and the like between the anchor 10 and shelter 100. In some examples, the anchor system is a multi-point anchor system adapted so that the apertures may engage the shelter at multiple points. The multiple points may be at more than two corners of the shelter and/or locations between two corners of the shelter.

Figure 4:
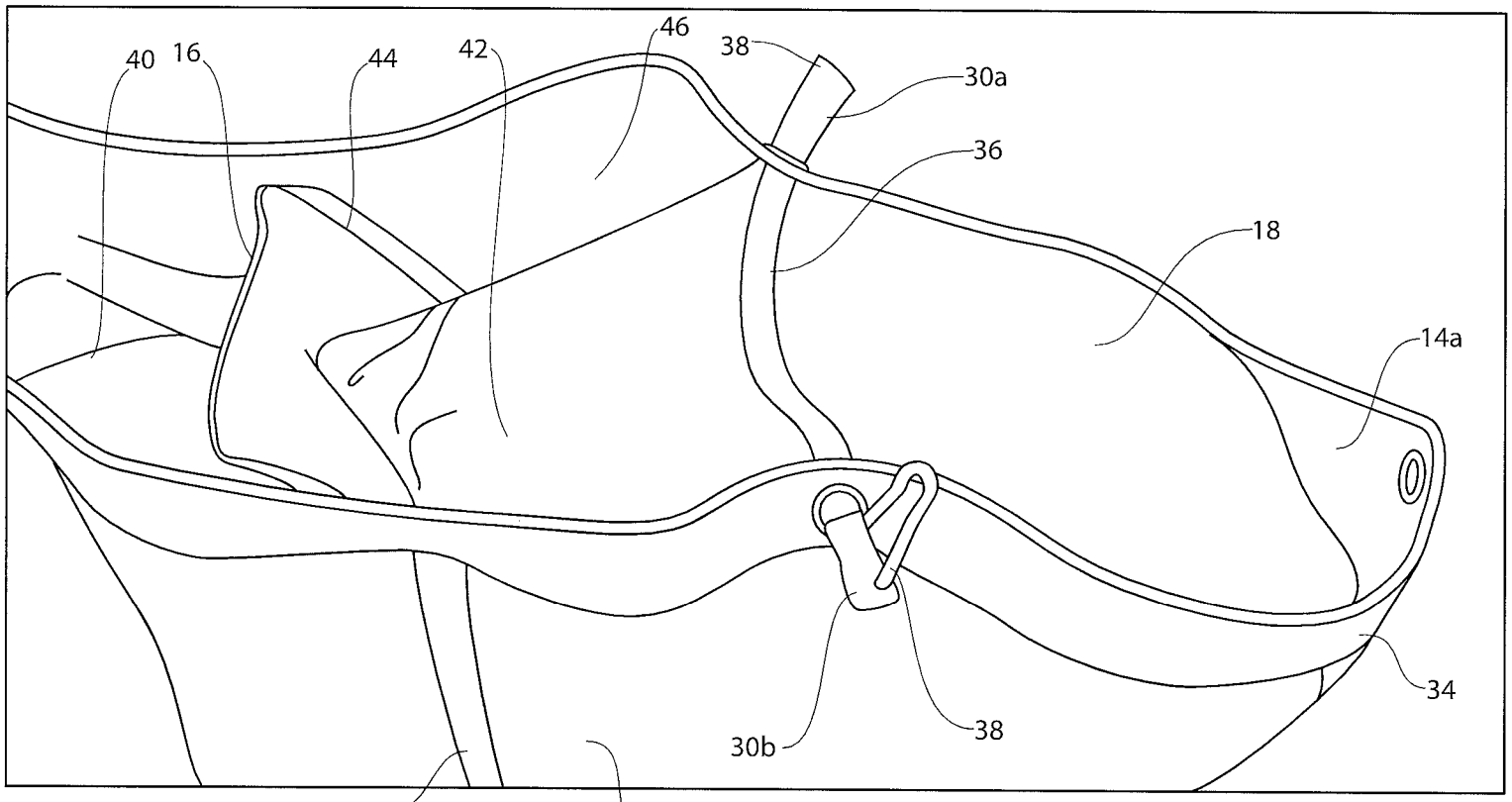
FIG. 4 is a top perspective view of an anchor system.

Anchor 10 includes a bladder to generally receive and retain any variety of filling materials. Certain examples of the anchor 10 includes an individual bladder, while other examples include segmented or partially-segmented bladders. Multiple bladders may be joined to create a double, triple and/or series of bladders. In one example, a bladder may form around a 20 to 40 gallon compartment. Smaller and larger bladder compartments are also within the scope of this invention. FIG. 4 shows one example of a partially segmented anchor having an inner sidewall 16 defining a first outer bladder and a second inner bladder 42. The inner sidewall 16 may have a height to generally segment bladder sections, while other examples include shorter heights or pass through ducts to allow fill material to flow between the bladder compartments. As shown and described herein, the inner sidewall 16 is generally secured between the opposing walls 12. The inner sidewall 16 may include a flange 44 affixed to the opposing walls 12. Further, the bladder may include a bladder liner 46 to generally protect the anchor from fill materials and handling. In some instances where the inner bladder is segmented into compartments, each bladder may be filled with varying materials.

As further shown in FIG. 4, a closure band 36 may be threaded through the opposing engagement apertures 30 and may cinch the top opening closed in an assembled position. In particular examples, the closure band is rigid, while other examples include a semi-elastic band. In addition, the segment 30*a* of the closure band 36 may be used to attach to a variety of guy leaders and the like, for instance through retainer 38. The retainer 38 may be carabineer, swivel or the like.

Any of the shelters 100 shown or described herein may include a variety of field deployment elements. For instance, the shelter may be light weight for easy carry transport and may include an articulated frame, robust coverings, canopy and canopy features, door openings, lighting features, power features, liners and additional water bladders, anchor weights, and sand bags. The shelters may be any size and multiple shelters may be joined through door openings to create scalable complexes with the advantages of the inventions herein. Particular shelter examples include, but are not limited thereto, a unit with floor space of about fifteen feet by twelve feet and an area of about one hundred and height square feet; a unit with floor space of fifteen feet by eighteen feet and an area of about two hundred and seventy feet; and a variety of other sizes.

In other embodiments, the disclosure includes a shelter kit. In this embodiment, the kit may comprise a shelter 100, e.g. any of the shelters previously shown or described, and a plurality of anchors 10, e.g. any of the anchors shown or described.

In yet another embodiment of the disclosure, included is a method for assembling a collapsed anchor 10 and securing the anchor 10 to a shelter. The method may include carrying the bag anchor 10 collapsed, separating and/or unfolding the walls 12, expanding the anchor 10, aligning the anchor 10 adjacent to a shelter and filling the anchor bladder with a fill materials, e.g. including any of the embodiments previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. An anchor system for use with a shelter, said system comprising:

a. a collapsible anchor having a pair of opposing walls and a pair of opposing sidewalls, the pair of opposing side walls having a wider lower portion and a narrow upper portion and separating the opposing first and second pair of walls, wherein said opposing walls and said opposing sidewalls define a top opening with an anchor bladder for accepting site available materials providing a weight within the bladder;

b. a plurality of engagement apertures spaced along an upper portion of said opposing walls, a first set of the engagement apertures positioned on one of said walls and a second set of the engagement apertures positioned on the opposing wall;

c. a closure band strung between two of said engagement apertures, whereby said closure band cinches said top opening by crossing over said top opening of said anchor between an engagement aperture in said first set of engagement apertures and an engagement aperture in said second set of engagement apertures; and d. a fastener interfaced with said closure band and adapted to secure a leader attaching to a shelter to said anchor for anchoring said shelter to a ground surface.

2. The system of claim 1, wherein said collapsible anchor includes an inner liner.

3. The system of claim 1, wherein said opposing walls and opposing side sidewalls define a semi-rigid frame.

4. The system of claim 3, wherein said semi-rigid frame is adapted to retain a substance chosen from water, dirt, rocks and sand.

5. The system of claim 1, wherein said plurality of engagement apertures are spaced evenly along said top opening.

6. The system of claim 1, wherein each of said anchor sidewalls at the wide lower portion traverses distally away from an anchor base.

7. The system of claim 1, wherein the system is portable.

8. An anchor system for securing a shelter to a ground surface, said anchor comprising:

a. an anchor body including:

i. a first wall and an opposing second wall, ii. a first sidewall and an opposing second side wall, said first wall, second wall, first sidewall and second sidewall defining an opening at a top of said anchor, iii. a base for supporting a weighted fill material on a ground surface and interfacing with said walls and sidewalls, iv. wherein said walls and side walls are impermeable to accommodate a variety of site available materials, b. said anchor being interchangeable between a folded position, where said walls and sidewalls are collapsed for lightweight transportation, and a deployed position, where said walls and sidewalls are extended so that said anchor is positioned to accept a variety of site available materials as the weighted fill material, c. an inner compartment formed by the walls and sidewalls, d. at least one inner dividing wall within said compartment, said inner dividing wall interfacing on one end with said first wall and on an opposite end with said second wall, e. a first bladder and a second bladder formed by the at least one inner dividing wall, said opening providing access to said first and second bladders to be filled with one of the variety of site available materials, f. a low center of gravity closer to the base than to the opening of said anchor, said low center of gravity formed by the onion shape of said anchor wherein said anchor has a wider lower portion and a narrower upper portion and said sidewalls extend distally outward away from said base and said walls, and g. an attachment strap extending from said anchor and securing said anchor to a shelter such that said shelter becomes secured to said ground surface.

* * * * *